US008966839B2

(12) United States Patent
Rebman et al.

(10) Patent No.: US 8,966,839 B2
(45) Date of Patent: Mar. 3, 2015

(54) WINDOW ASSEMBLY

(75) Inventors: Robert J. Rebman, Winneconne, WI (US); Daniel J. Springhetti, Neenah, WI (US); Donald J. Saringer, Neenah, WI (US); Brian S. Cleveland, Neenah, WI (US); Robert R. Wright, III, Orlando, FL (US); Kevin P. Filley, Orlando, FL (US)

(73) Assignee: Quiet Energy Services, LLC, Neenah, WI (US)

( * ) Notice: Subject to any disclaimer, the term of this patent is extended or adjusted under 35 U.S.C. 154(b) by 0 days.

(21) Appl. No.: 14/236,442

(22) PCT Filed: Aug. 15, 2012

(86) PCT No.: PCT/US2012/050958
§ 371 (c)(1),
(2), (4) Date: Jan. 31, 2014

(87) PCT Pub. No.: WO2013/025811
PCT Pub. Date: Feb. 21, 2013

(65) Prior Publication Data

US 2014/0144090 A1 May 29, 2014

Related U.S. Application Data

(60) Provisional application No. 61/523,556, filed on Aug. 15, 2011.

(51) Int. Cl.
*E06B 3/28* (2006.01)
*E06B 3/263* (2006.01)
(Continued)

(52) U.S. Cl.
CPC . *E06B 3/263* (2013.01); *E06B 3/28* (2013.01); *E06B 3/9641* (2013.01); *E06B 3/301* (2013.01)
USPC ..... 52/203; 52/202

(58) Field of Classification Search
CPC ..... E06B 3/28; E06B 2009/005; E06B 3/285; E06B 1/6046; E06B 2003/6291; E06B 2009/587
USPC ..... 52/202, 203
See application file for complete search history.

(56) References Cited

U.S. PATENT DOCUMENTS 3,745,704 A * 7/1973 Covington ..... 49/57
3,992,815 A * 11/1976 Potter ..... 49/62
4,121,394 A * 10/1978 Brooks ..... 52/203
(Continued)

FOREIGN PATENT DOCUMENTS

KR 2019980058166 10/1998
KR 200397158 9/2005
KR 100890036 4/2009

OTHER PUBLICATIONS

International Search Report and Written Opinion for Application No. PCT/US2012/050958 dated Feb. 28, 2013 (9 pages).

*Primary Examiner* — Brian Glessner
*Assistant Examiner* — Joshua Ihezie
(74) *Attorney, Agent, or Firm* — Michael Best & Friedrich LLP

(57) ABSTRACT

A window assembly, adapted to be positioned within a window frame, includes a retainer attachable to the window frame, a transparent panel having an edge, and a frame member attached to the edge and including a lip extending along a substantial length of the frame member. The lip is secured to the retainer by a snap-fit.

17 Claims, 15 Drawing Sheets

(51) Int. Cl.
*E06B 3/30* (2006.01)
*E06B 3/964* (2006.01)

(56) References Cited

U.S. PATENT DOCUMENTS

| | | | | | |
|---|---|---|---|---|---|
| 4,160,348 | A | * | 7/1979 | Chapman et al. | 52/202 |
| 4,164,105 | A | * | 8/1979 | Herbst et al. | 52/202 |
| 4,182,088 | A | * | 1/1980 | Ball | 52/202 |
| 4,248,018 | A | * | 2/1981 | Casamayor | 49/504 |
| 4,295,305 | A | * | 10/1981 | Shelver | 52/172 |
| 4,320,609 | A | * | 3/1982 | Abell | 52/202 |
| 4,333,284 | A | * | 6/1982 | Meadows | 52/222 |
| 4,351,137 | A | * | 9/1982 | Enyart et al. | 52/202 |
| 4,363,192 | A | * | 12/1982 | Soucy | 49/453 |
| 4,364,209 | A | * | 12/1982 | Gebhard | 52/208 |
| 4,399,640 | A | * | 8/1983 | Porter | 52/202 |
| 4,409,758 | A | * | 10/1983 | Dickerson et al. | 49/463 |
| 4,441,290 | A | * | 4/1984 | Abell | 52/202 |
| 4,452,020 | A | * | 6/1984 | Werner | 52/202 |
| 4,462,186 | A | * | 7/1984 | Fuller | 49/463 |
| 4,472,914 | A | * | 9/1984 | DeBoef et al. | 52/202 |
| 4,544,012 | A | * | 10/1985 | Woodward | 160/90 |
| 4,561,223 | A | * | 12/1985 | Gold et al. | 52/202 |
| 4,581,865 | A | * | 4/1986 | Miller | 52/202 |
| 4,592,180 | A | * | 6/1986 | Gerritsen | 52/203 |
| RE32,509 | E | * | 9/1987 | Werner | 52/202 |
| 4,702,050 | A | * | 10/1987 | Giguere | 52/202 |
| 4,733,510 | A | * | 3/1988 | Werner | 52/202 |
| 4,858,405 | A | * | 8/1989 | Christie | 52/208 |
| 5,086,604 | A | * | 2/1992 | Orth | 52/745.16 |
| 5,218,799 | A | * | 6/1993 | Appino | 52/213 |
| 5,253,457 | A | * | 10/1993 | Orth | 52/202 |
| 5,485,705 | A | * | 1/1996 | Guillemet | 52/656.9 |
| 5,603,190 | A | * | 2/1997 | Sanford | 52/202 |
| 5,649,389 | A | * | 7/1997 | Coddens | 49/419 |
| 5,806,256 | A | * | 9/1998 | Byrne | 52/204.5 |
| 6,012,257 | A | * | 1/2000 | Caplette | 52/202 |
| 6,058,667 | A | * | 5/2000 | MacDonald et al. | 52/239 |
| 6,269,597 | B1 | * | 8/2001 | Haas | 52/203 |
| 6,619,003 | B2 | * | 9/2003 | Von Arx et al. | 52/222 |
| 6,832,457 | B2 | * | 12/2004 | Geiger | 52/656.5 |
| 6,845,593 | B2 | * | 1/2005 | Silverman | 52/655.1 |
| 6,877,285 | B2 | * | 4/2005 | Poma et al. | 52/202 |
| 6,886,300 | B2 | * | 5/2005 | Hudoba et al. | 52/222 |
| 7,134,243 | B2 | * | 11/2006 | Emek | 52/1 |
| 7,174,939 | B1 | * | 2/2007 | Spencer | 160/90 |
| 7,278,241 | B2 | * | 10/2007 | Wirawan | 52/203 |
| 7,624,548 | B2 | * | 12/2009 | Hansen et al. | 52/202 |
| 7,775,256 | B2 | * | 8/2010 | Kim | 160/381 |
| 8,028,489 | B1 | * | 10/2011 | Lawrence | 52/656.7 |
| 2002/0184839 | A1 | * | 12/2002 | Emek | 52/202 |
| 2002/0184840 | A1 | * | 12/2002 | Farrar et al. | 52/202 |
| 2005/0210777 | A1 | * | 9/2005 | Baughn et al. | 52/202 |
| 2006/0174561 | A1 | * | 8/2006 | Hansen et al. | 52/202 |
| 2008/0016798 | A1 | * | 1/2008 | Miller | 52/202 |
| 2009/0288353 | A1 | * | 11/2009 | Barsby et al. | 52/202 |

* cited by examiner

WINDOW ASSEMBLY

CROSS-REFERENCE TO RELATED APPLICATIONS

This application claims priority to U.S. Provisional Patent Application No. 61/523,556 filed Aug. 15, 2011, the entire content of which is incorporated herein by reference.

FIELD OF THE INVENTION

The present invention relates to windows, and more particularly to window coverings.

BACKGROUND OF THE INVENTION

Numerous products are in the marketplace for covering or insulating windows in residential and commercial buildings to reduce the amount of thermal energy transferred through the windows. Such window coverings may be used during the winter when it is desirable to reduce the amount of heat in the residential or commercial building that is lost to the environment through the windows. Likewise, such window coverings may be used during the summer when it is desirable to reduce the amount of conditioned air in the residential or commercial building that is lost to the environment through the windows.

For example, such a window covering may include a thin, plastic sheet adhered to the periphery of the window frame to provide an insulation space between the sheet and the window sash or sashes. However, such window coverings are typically difficult to install and are unsightly. Other such window coverings may include a polymer-based panel and separate frame segments surrounding the periphery of the panel. However, such window coverings are typically fastened to the window frame either directly or using intermediate brackets. When such window coverings are removed from the window frame, however, the installation holes in the window frame from the fasteners, or the intermediate brackets if used, are often unsightly.

SUMMARY OF THE INVENTION

The invention provides, in one aspect, a window assembly adapted to be positioned within a window frame. The window assembly includes a retainer attachable to the window frame, a transparent panel having an edge, and a frame member attached to the edge and including a lip extending along a substantial length of the frame member. The lip is secured to the retainer by a snap-fit.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
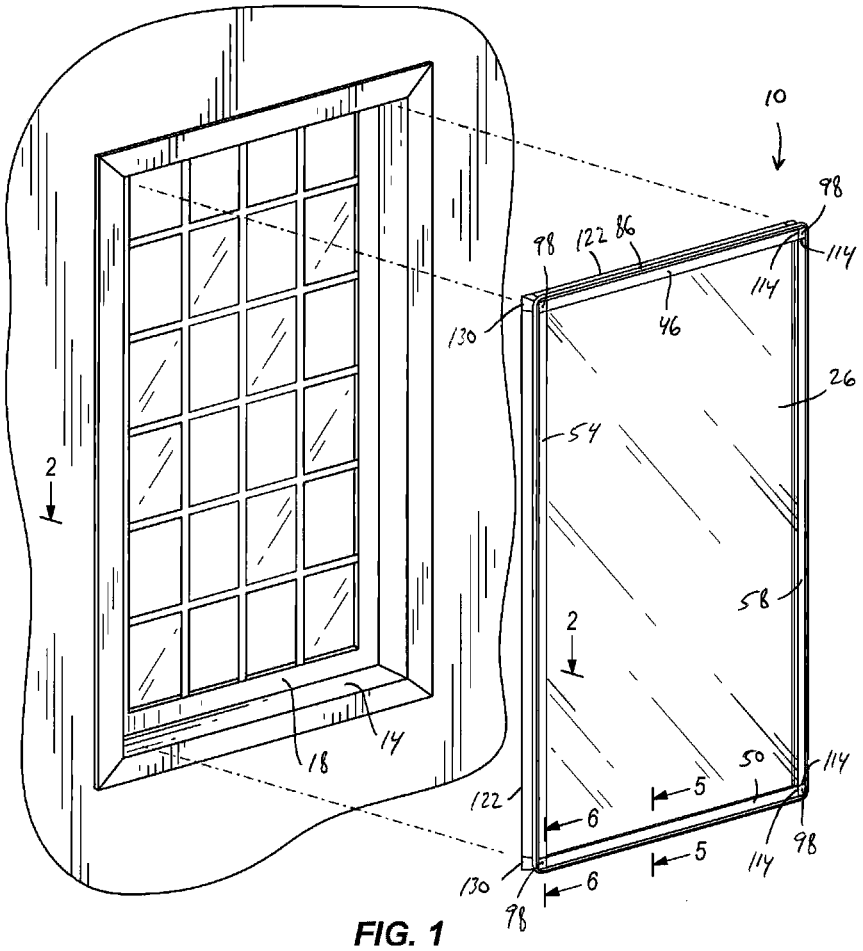
FIG. 1 is a perspective view of a window assembly according to one embodiment of the invention exploded from a window frame and sash.

FIG. 1 illustrates a window assembly 10 that is removably coupled to a window frame 14 in the interior of a residential, commercial, or other type of building. As is discussed below in more detail, the window assembly 10 is positioned in the window frame 14 and spaced from a sash 18 supported in the window frame 14 to provide an air pocket 22 between the sash 18 and the window assembly 10 (FIG. 2) that increases the effective thermal resistance or insulation value (i.e., "R-value") of the sash 18, thereby reducing the amount of thermal energy transferred through the sash 18, both to and from the interior environment of the building. Alternatively, the window assembly 10 may be positioned in a window frame on the exterior of the building.

Figure 3:
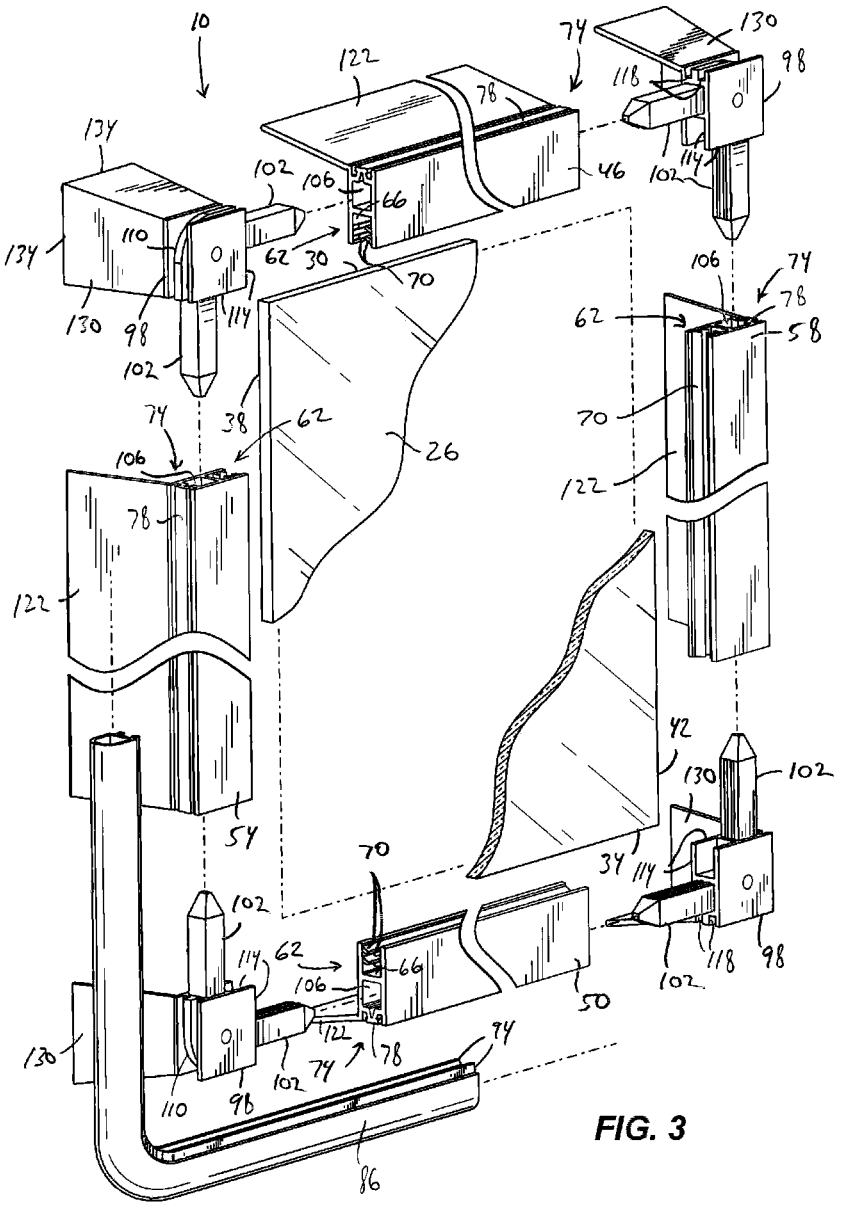
FIG. 3 is an exploded perspective view of the window assembly of FIG. 1.
Figure 4:
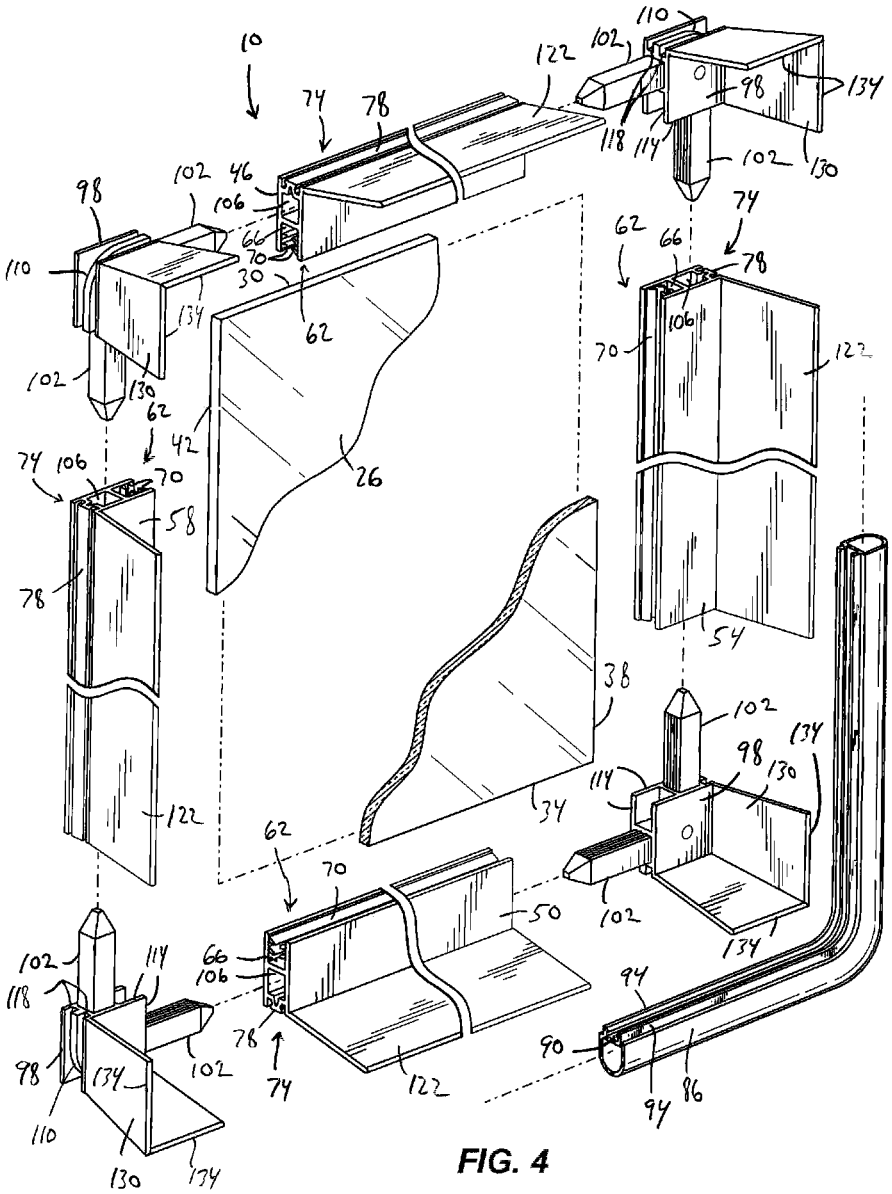
FIG. 4 is a reverse, exploded perspective view of the window assembly of FIG. 3.

With reference to FIGS. 3 and 4, the window assembly 10 includes a panel 26 having a top edge 30, a bottom edge 34, and two side edges 38, 42 interconnecting the top and bottom edges 30, 34. The panel 26 is transparent, and may be made from a plastic material or glass. Preferably, the panel 26 is made from a transparent thermoplastic, such as an acrylate polymer (for example, polymethyl methacrylate or polycarbonate).

The window assembly 10 also includes elongated top, bottom, and side frame members 46, 50, 54, 58 that are attached, respectively, to the top, bottom, and side edges 30, 34, 38, 42 of the panel 26. Each of the frame members 46, 50, 54, 58 includes a substantially identical cross-sectional shape in a plane that is oriented normal to the length of the respective frame members 46, 50, 54, 58. The frame members 46, 50, 54, 58 may also be made from a plastic material and manufactured using an extrusion process. As such, the frame members 46, 50, 54, 58 can be manufactured in generic or standard lengths, and custom trimmed by the end user (e.g., using shears or a saw) in accordance with the particular dimensions of the window frame 14 in which the window assembly 10 will be installed.

With continued reference to FIGS. 3 and 4, each of the frame members 46, 50, 54, 58 includes an inboard portion 62 to which the panel 26 is attached. In the illustrated construction of the window assembly 10, the inboard portion 62 of each of the frame members 46, 50, 54, 58 includes a channel 66 and four resiliently deflectable fingers 70 extending into the channel 66. Particularly, the fingers 70 are grouped in opposed pairs, and the panel 26 is engaged by the fingers 70 when inserted into the channel 66 (see also FIG. 5). The fingers 70 deflect downwardly from the frame of reference of FIG. 5 in response to insertion of the panel 26 between the fingers 70. The fingers 70, therefore, effectively function as barbs to secure the frame members 46, 50, 54, 58 to the respective edges 30, 34, 38, 42 of the panel 26 and inhibit inadvertent removal of the frame members 46, 50, 54, 58 from the panel 26. In the illustrated construction of the window assembly 10, the fingers 70 are integrally formed as a single piece with the remainder of the respective frame members 46, 50, 54, 58 using a dual-durometer extrusion process. As such, the fingers 70 may be extruded using a flexible polymeric material (e.g., flexible PVC), while the remainder of the frame members 46, 50, 54, 58 may be extruded using a rigid polymeric material (e.g., rigid PVC). Alternatively, more or fewer fingers 70 may be used in each of the frame members 46, 50, 54, 58. As a further alternative, the inboard portion 62 of each of the frame members 46, 50, 54, 58 may include different structure for securing the frame members 46, 50, 54, 58 to the respective edges 30, 34, 38, 42 of the panel 26 (e.g., fasteners, adhesives, etc.).

Figure 5:
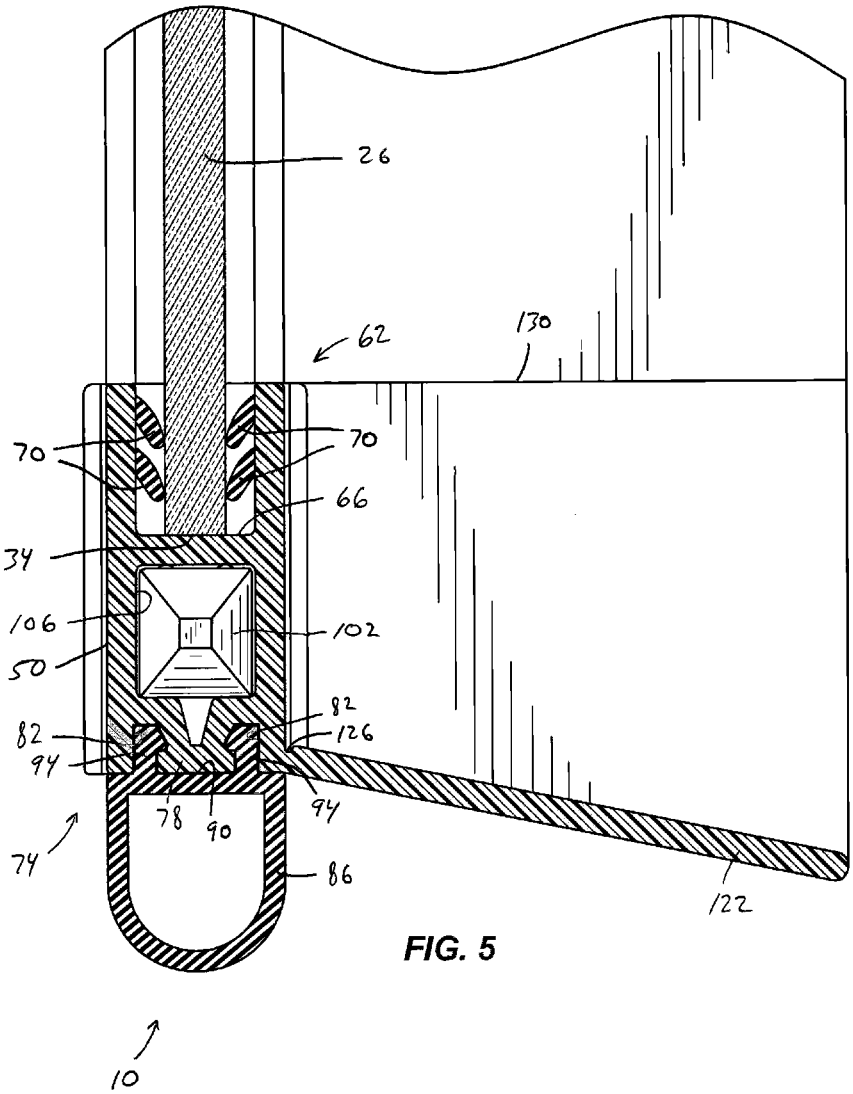
FIG. 5 is a cross-sectional view of the window assembly of FIG. 1 along line 5-5.

With reference to FIGS. 3 and 4, each of the frame members 46, 50, 54, 58 also includes an outboard portion 74 including a projection 78 extending along the length of each of the frame members 46, 50, 54, 58. As shown in FIG. 5, the projection 78 is somewhat T-shaped, and a recess 82 is defined on either side of the projection 78. Alternatively, the projection 78 may be configured having any of a number of different cross-sectional shapes.

The window assembly 10 also includes a seal 86 coupled to the outboard portion 74 of each of the frame members 46, 50, 54, 58. With continued reference to FIG. 5, the seal 86 includes a groove 90 having a cross-sectional shape that is complementary to the cross-sectional shape of the projection 78 on each of the frame members 46, 50, 54, 58 such that the projection 78 may be received within the groove 90. The groove 90 is defined by spaced tangs 94 having a complementary shape to the respective recesses 82 in which the tangs 94 are received. The inter-engagement of the tangs 94 and the projection 78 secures the seal 86 to each of the frame members 46, 50, 54, 58, and is sufficient to substantially inhibit the seal 86 from being inadvertently removed from the respective frame members 46, 50, 54, 58. Alternatively, the tangs 94 and the recesses 82 may have any of a number of different complementary cross-sectional shapes to secure the seal 86 to each of the frame members 46, 50, 54, 58.

Figure 2:
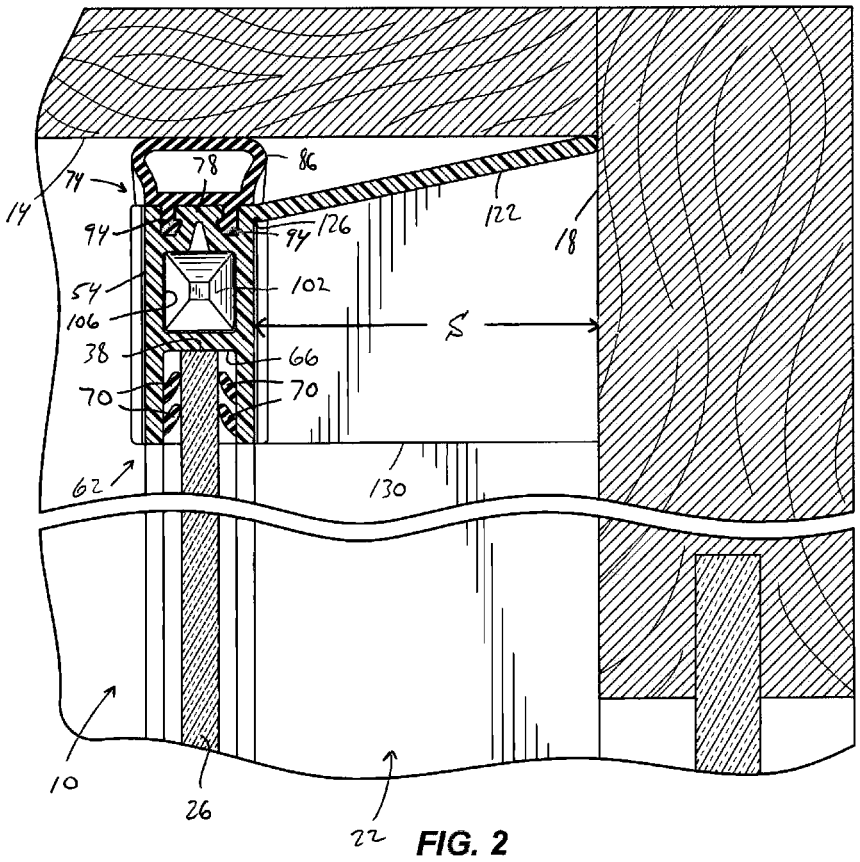
FIG. 2 is a cross-sectional view of the window assembly of FIG. 1, along line 2-2, installed in the window frame.

The seal 86 is made from an elastomeric material (e.g., a natural rubber or a synthetic rubber), and is deformable or flexible in response to the window assembly 10 being installed or inserted into the window frame 14 (see FIG. 2). As such, the seal 86 can adapt the window assembly 10 for use with window frames 14 having adjacent sides that are not square (i.e., angularly spaced by ninety degrees). Such adaptability also permits an increased margin of error when sizing the panel 26 for a particular window frame 14. For example, the seal 86 may accommodate up to about one-half of an inch of variation of the length and/or width of the panel 26 when sizing multiple panels 26 for the same size window frame 14.

With reference to FIGS. 3 and 4, the window assembly 10 includes four corner members 98 interconnecting adjacent frame members 46, 50, 54, 58. Each of the corner members 98 includes two protrusions or posts 102 that define an included angle of about ninety degrees. As a result, when adjacent frame members 46, 50, 54, 58 are interconnected by a corner member 98, the included angle between the adjacent frame members 46, 50, 54, 58 is also about ninety degrees. Each of the frame members 46, 50, 54, 58 includes an aperture 106 extending longitudinally and positioned between the inboard portion 62 and the outboard portion 74 of the frame member 46, 50, 54, 58. In the illustrated construction of the window assembly 10, the posts 102 and the apertures 106 include complementary square cross-sectional shapes to permit the posts 102 to be received within the apertures 106. Alternatively, the posts 102 and the apertures 106 may include any number of different complementary cross-sectional shapes to interconnect adjacent frame members 46, 50, 54, 58. Also, in the illustrated construction of the window assembly 10, the posts 102 are interference fit to the respective apertures 106 to interconnect and secure the corner members 98 to adjacent frame members 46, 50, 54, 58. Alternatively, different structure may be utilized to secure the corner members 98 to the frame members 46, 50, 54, 58 after the posts 102 have been inserted into the apertures 106 (e.g., a set screw, adhesives, etc.).

The combination of the frame members 46, 50, 54, 58 and the four corner members 98 may be considered a frame assembly which, in alternative constructions of the window assembly 10, may include fewer than eight total pieces (i.e., four frame members 46, 50, 54, 58 and four corner members 98). For example, the frame assembly may be configured as two pieces that interconnect and capture therebetween the panel 26. As a further alternative, the frame assembly may be integrally formed as a single piece around the panel 26, which would be cut to a standard window frame size.

Figure 6:
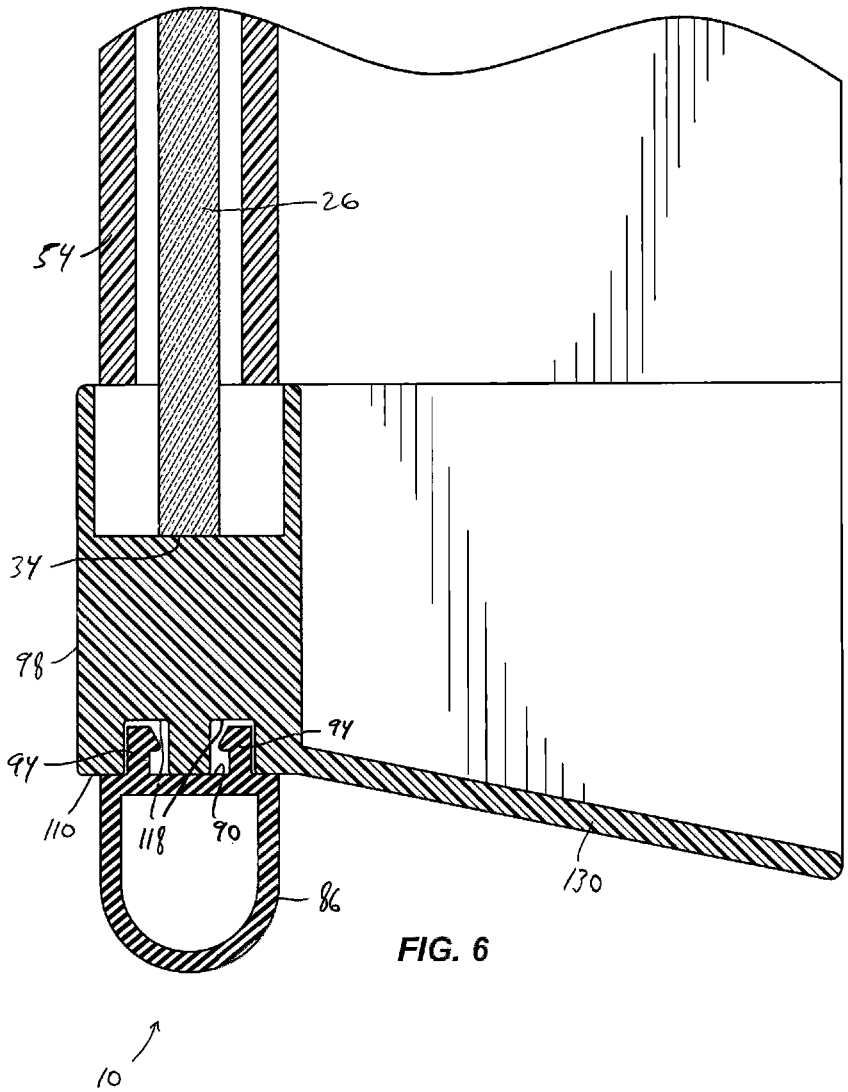
FIG. 6 is a cross-sectional view of the window assembly of FIG. 1 along line 6-6.

With continued reference to FIGS. 3 and 4, each of the corner members 98 includes an outboard edge 110 defined by a radius to facilitate wrapping the seal 86 around the corner member 98 and transitioning the seal 86 from one frame member 46, 50, 54, 58 to another. Particularly, the corner member 98 reorients the seal 86 to permit the seal 86 to span respective interfaces 114 between the corner member 98 and adjacent frame members 46, 50, 54, 58. In this manner, the seal 86 may be configured as a single length, having opposed ends which are subsequently bonded (e.g., using an adhesive, etc.) after being wrapped around the outboard portions 74 of the respective frame members 46, 50, 54, 58 and the outboard edges 110 of the corner members 98. In the illustrated construction of the window assembly 10, each of the corner members 98 includes two spaced, parallel grooves 118 formed in the outboard edge 110 in which the respective tangs 94 of the seal 86 are positioned (see FIG. 6). Consequently, the seal 86 may sit flush against the outboard edge 110. The width and depth of each of the grooves 118 are sized to provide a clearance fit with the tangs 94.

With reference to FIGS. 2 and 4, each of the frame members 46, 50, 54, 58 includes an extension or lip 122 engaged with the sash 18 to facilitate consistent spacing between the panel 26 and the sash 18 near each edge 30, 34, 38, 42 of the panel 26. Moreover, each of the lips 122 is sized to optimize the depth of the air pocket 22. For example, in the illustrated construction of the window assembly 10, the lips 122 are sized to provide a linear dimension S between the frame members 46, 50, 54, 58 and the sash 18 of about one inch.

Alternatively, the lips 122 may be sized to provide any of a number of different depth values depending upon the particular individual insulation valves of the panel 26 and the sash 18. With continued reference to FIG. 2, each of the frame members 46, 50, 54, 58 includes a notch 126 at the base of the lip 122 to facilitate resilient deflection of the lip 122 when the window assembly 10 is installed in the window frame 14. As such, the lips 122 of the respective frame members 46, 50, 54, 58, if deflected, may develop a frictional force with the individual sides of the window frame 14 to secure the window assembly 10 within the frame 14.

Each of the corner members 98 includes an extension or lip 130, which is also configured to space the window assembly 10 from the sash 18 (FIG. 4). Each of the lips 130 includes adjacent edges 134 defining an included angle of about ninety degrees. The lips 130 are not configured to deflect substantially when the window assembly 10 is installed in the window frame 14. The lips 130 are sized in accordance with the lips 122 on the frame members 46, 50, 54, 58 to provide the same spacing relative to the sash 18 as the frame members 46, 50, 54, 58.

To create the window assembly 10, one would first cut the panel 26 to appropriate length and width dimensions. Then, the corner members 98 may be positioned on the respective corners of the panel 26, and the distance between the facing interfaces 114 of opposed corner members 98 may be measured to obtain the length of the frame member 46, 50, 54, 58 extending between those two corner members 98. If provided in standard lengths, the top, bottom, and side frame members 46, 50, 54, 58 are then individually cut according to the measured lengths of the respective frame members 46, 50, 54, 58. After the frame members 46, 50, 54, 58 are cut to length and the corner members 98 have been removed from the panel 26, the side edges 38, 42 of the panel 26 are inserted into the channels 66 of the side frame members 54, 58, causing the fingers 70 to resiliently deflect thereby securing the side frame members 54, 58 to the panel 26.

Two corner members 98 may then be attached to the respective ends of each of the top frame member 46 and the bottom frame member 50. The pre-assembled corner members 98 and frame members 46, 50 may then be attached to the top and bottom edges 30, 34 of the panel 26, simultaneously inserting the vertically oriented posts 102 of the corner members 98 (i.e., from the frame of reference of FIG. 3) into the apertures 106 of the side frame members 54, 58. Lastly, the seal 86 may be wrapped around the assembled frame members 46, 50, 54, 58 and corner members 98, during which the projection 78 of each of the frame members 46, 50, 54, 58 is inserted into the groove 90 in the seal 86. If the seal 86 is provided as a single length having opposed ends, the ends may then be bonded (e.g., using an adhesive, etc.) such that the seal 86 is contiguous and spans all of the interfaces 114 between the corner members 98 and the frame members 46, 50, 54, 58.

The completed window assembly 10 is then installed (i.e., pushed) into the window frame 14 until the lips 122, 130 of the respective frame members 46, 50, 54, 58 and the corner members 98 contact the sash 18. Upon contact with the sash 18, the window assembly 10 is spaced from the sash 18 an optimal distance to increase the effective R-value of the sash 18.

Figure 7:
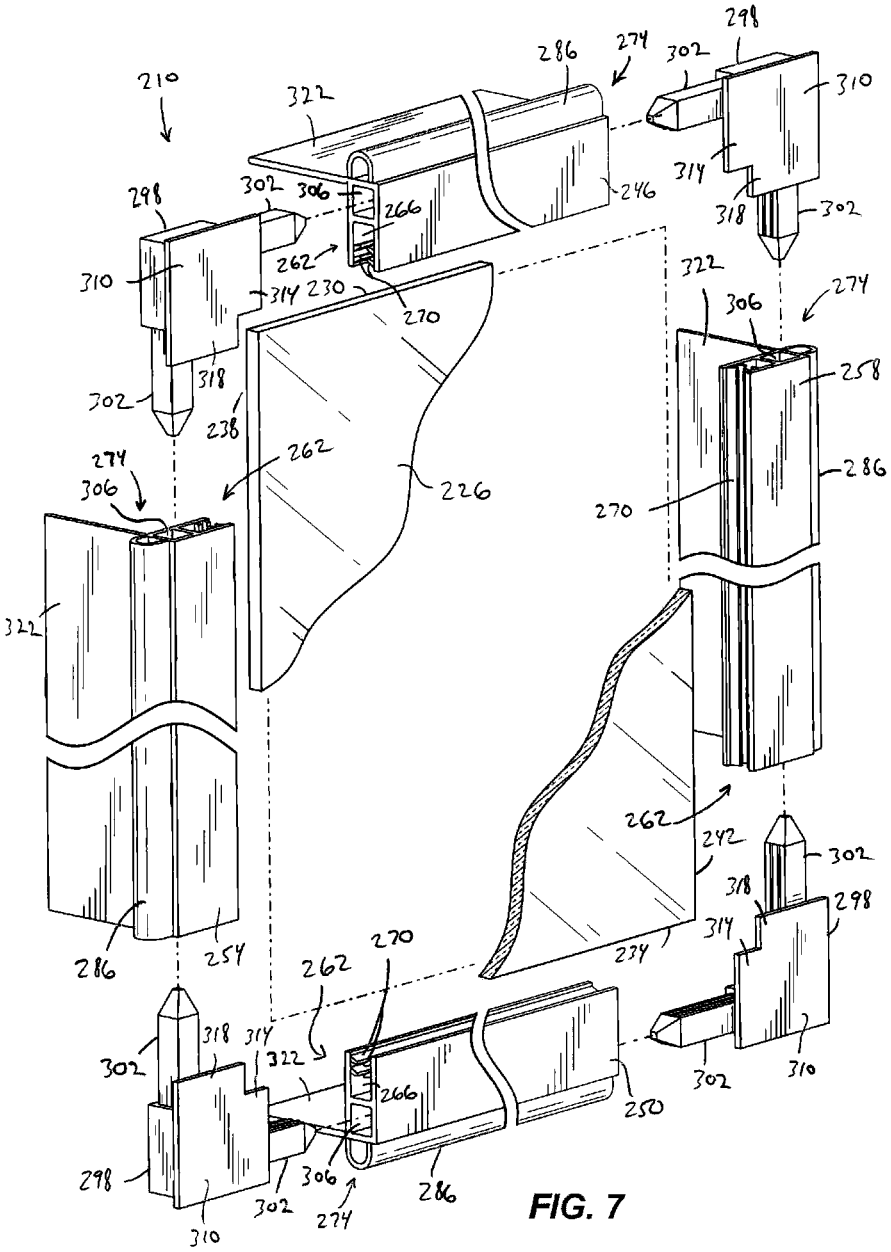
FIG. 7 is an exploded perspective view of a window assembly according to another embodiment of the invention.
Figure 8:
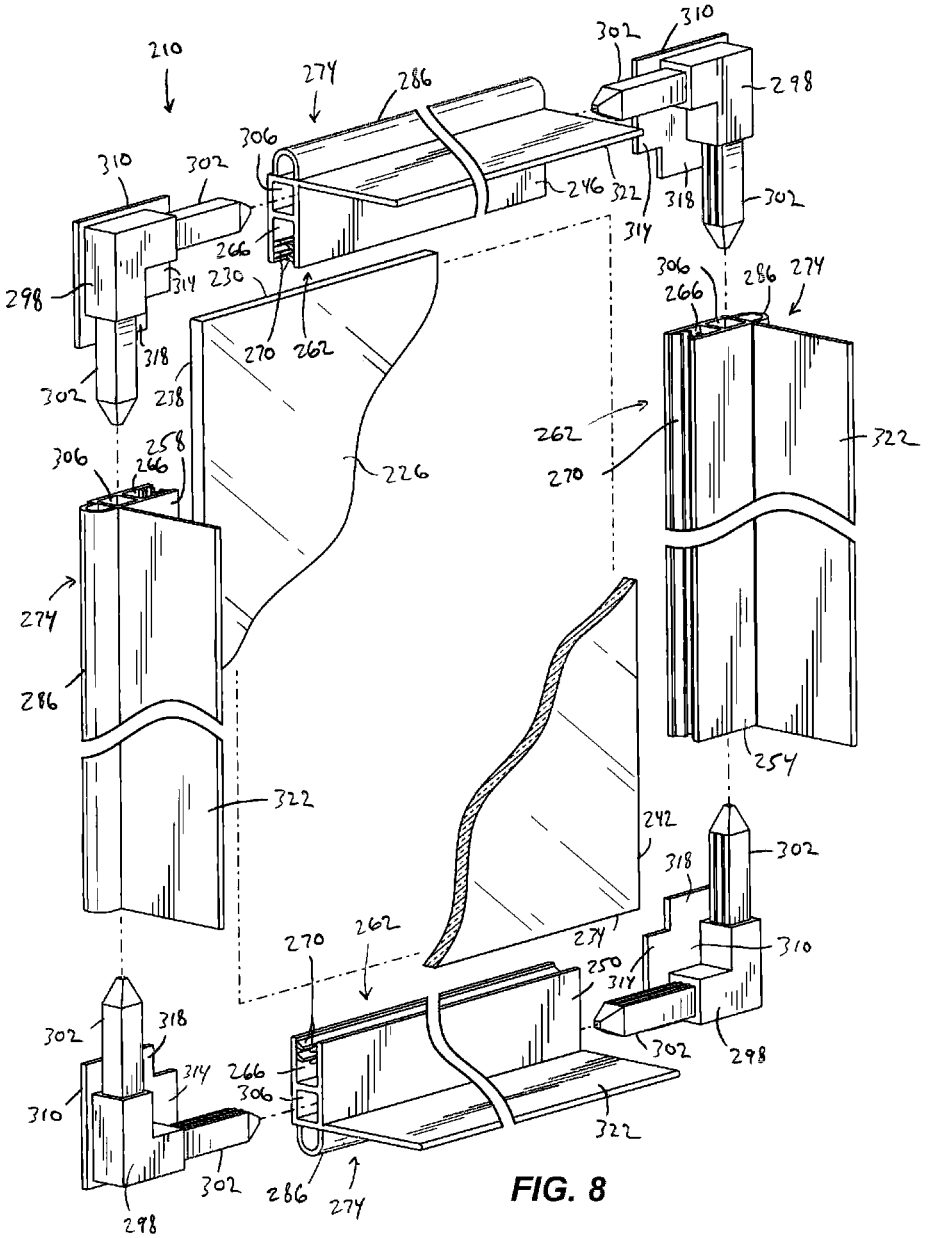
FIG. 8 is a reverse, exploded perspective view of the window assembly of FIG. 7.
Figure 9:
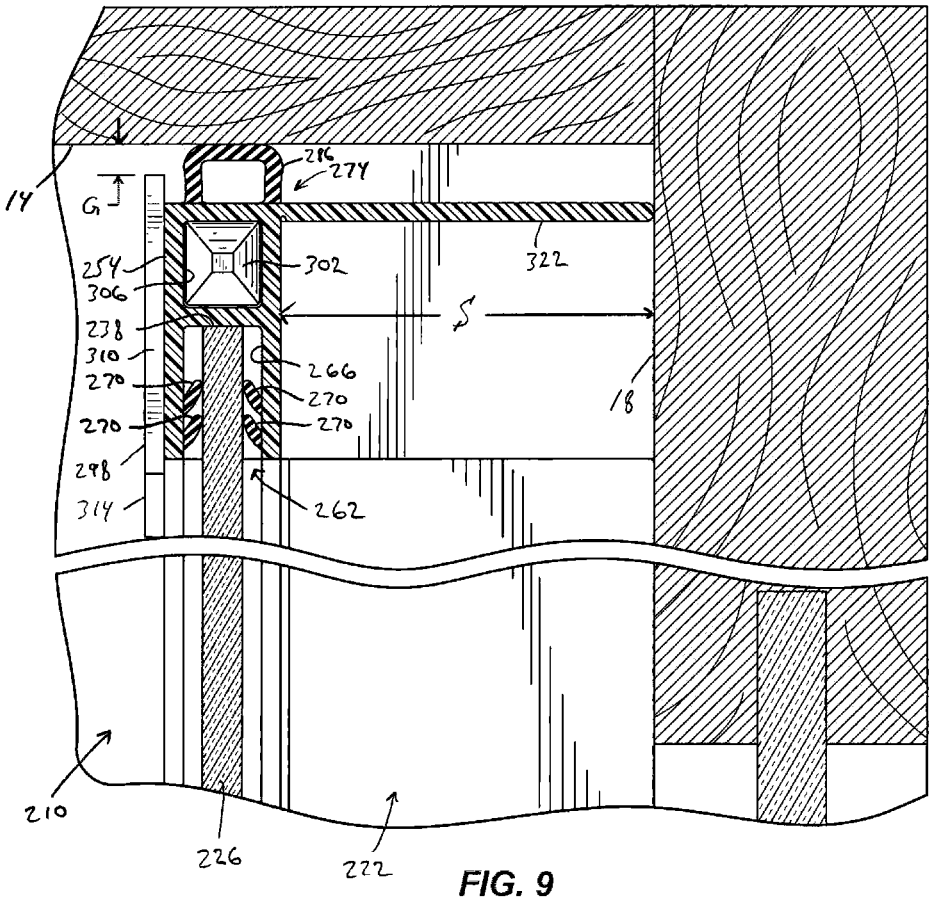
FIG. 9 is a cross-sectional view of the window assembly of FIG. 7 installed within a window frame and sash.

FIGS. 7-9 illustrate a window assembly 210 according to another embodiment of the invention that may be removably coupled to the window frame 14 shown in FIG. 1. With reference to FIGS. 7 and 8, the window assembly 210 includes a panel 226 having a top edge 230, a bottom edge 234, and two side edges 238, 242 interconnecting the top and bottom edges 230, 234. The panel 226 is transparent, and may be made from a plastic material or glass. Preferably, the panel 226 is made from a transparent thermoplastic, such as an acrylate polymer (for example, polymethyl methacrylate or polycarbonate).

The window assembly 210 also includes elongated top, bottom, and side frame members 246, 250, 254, 258 that are attached, respectively, to the top, bottom, and side edges 230, 234, 238, 242 of the panel 226. Each of the frame members 246, 250, 254, 258 includes a substantially identical cross-sectional shape in a plane that is oriented normal to the length of the respective frame members 246, 250, 254, 258. The frame members 246, 250, 254, 258 may also be made from a plastic material and manufactured using an extrusion process. As such, the frame members 246, 250, 254, 258 can be manufactured in generic or standard lengths, and custom trimmed by the end user (e.g., using shears or a saw) in accordance with the particular dimensions of the window frame 14 in which the window assembly 210 will be installed.

With continued reference to FIGS. 7 and 8, each of the frame members 246, 250, 254, 258 includes an inboard portion 262 to which the panel 226 is attached. In the illustrated construction of the window assembly 210, the inboard portion 262 of each of the frame members 246, 250, 254, 258 includes a channel 266 and four resiliently deflectable fingers 270 extending into the channel 266. Particularly, the fingers 270 are grouped in opposed pairs, and the panel 226 is engaged by the fingers 270 when inserted into the channel 266 (see also FIG. 9). The fingers 270 deflect upwardly from the frame of reference of FIG. 9 in response to insertion of the panel 226 between the fingers 270. The fingers 270, therefore, effectively function as barbs to secure the frame members 246, 250, 254, 258 to the respective edges 230, 234, 238, 242 of the panel 226 and inhibit inadvertent removal of the frame members 246, 250, 254, 258 from the panel 226. In the illustrated construction of the window assembly 210, the fingers 270 are integrally formed as a single piece with the remainder of the respective frame members 246, 250, 254, 258 using a dual-durometer extrusion process. As such, the fingers 270 may be extruded using a flexible polymeric material (e.g., flexible PVC), while the remainder of the frame members 246, 250, 254, 258 may be extruded using a rigid polymeric material (e.g., rigid PVC). Alternatively, more or fewer fingers 270 may be used in each of the frame members 246, 250, 254, 258. As a further alternative, the inboard portion 262 of each of the frame members 246, 250, 254, 258 may include different structure for securing the frame members 246, 250, 254, 258 to the respective edges 230, 234, 238, 242 of the panel 226 (e.g., fasteners, adhesives, etc.).

With reference to FIGS. 7 and 8, each of the frame members 246, 250, 254, 258 also includes an outboard portion 274 including a seal 286. The seal 286 is made from a polymeric material (e.g., flexible PVC), and is deformable or flexible in response to the window assembly 210 being installed or inserted into the window frame 14 (FIG. 9). As such, the seal 286 can adapt the window assembly 210 for use with window frames 14 having adjacent sides that are not square (i.e., angularly spaced by ninety degrees). Such adaptability also permits an increased margin of error when sizing the panel 226 for a particular window frame 14. For example, the seal 286 may accommodate up to about one-half of an inch of variation of the length and/or width of the panel 226 when sizing multiple panels 226 for the same size window frame 14. In the illustrated construction of the window assembly 210, the seal 286 is integrally formed as a single piece with the remainder of the respective frame members 246, 250, 254, 258 using a dual-durometer extrusion process. As such, the seals 286 may be extruded using a flexible polymeric material (e.g., flexible PVC), while the remainder of the frame members 246, 250, 254, 258 may be extruded using a rigid polymeric material (e.g., rigid PVC).

Figure 13:
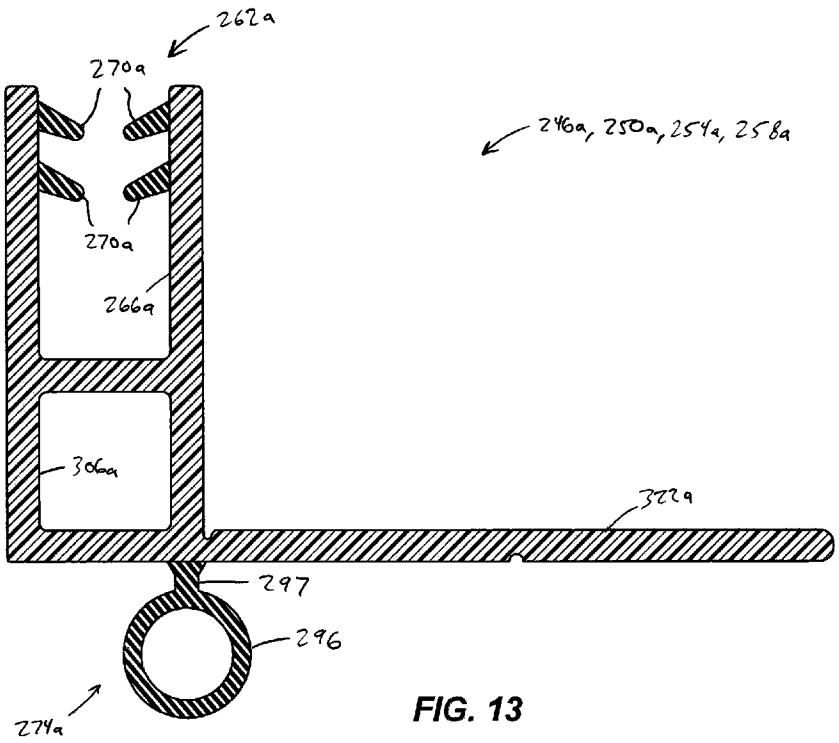
FIG. 13 is a cross-sectional view of an alternative construction of the frame members of the window assembly of FIG. 7.

FIG. 13 illustrates an alternative construction of the frame members. Like features are identified with like reference numerals with the letter "a" and will not be described again in detail. Each of the frame members 246*a*, 250*a*, 254*a*, 258*a* includes a seal 296 having a cylindrical shape that is spaced from the bodies of the respective frame members 246*a*, 250*a*, 254*a*, 258*a* by a stem 297. The seal 296 is deformable or flexible in a similar manner as the seal 286 described above and shown in FIGS. 7-9.

With reference to FIGS. 7 and 8, the window assembly 210 includes four corner members 298 interconnecting adjacent frame members 246, 250, 254, 258. Each of the corner members 298 includes two protrusions or posts 302 that define an included angle of about ninety degrees. As a result, when adjacent frame members 246, 250, 254, 258 are interconnected by a corner member 298, the included angle between the adjacent frame members 246, 250, 254, 258 is also about ninety degrees. Each of the frame members 246, 250, 254, 258 includes an aperture 306 extending longitudinally and positioned between the inboard portion 262 and the outboard portion 274 of the frame member 246, 250, 254, 258. In the illustrated construction of the window assembly 210, the posts 302 and the apertures 306 include complementary square cross-sectional shapes to permit the posts 302 to be received within the apertures 306. Alternatively, the posts 302 and the apertures 306 may include any number of different complementary cross-sectional shapes to interconnect adjacent frame members 246, 250, 254, 258. Also, in the illustrated construction of the window assembly 210, the posts 302 are interference fit to the respective apertures 306 to interconnect and secure the corner members 298 to adjacent frame members 246, 250, 254, 258. Alternatively, different structure may be utilized to secure the corner members 298 to the frame members 246, 250, 254, 258 after the posts 302 have been inserted into the apertures 306 (e.g., a set screw, adhesives, etc.).

With continued reference to FIGS. 7 and 8, each of the corner members 298 includes a wall 310 having a first portion 314 that overlies at least a portion of one of the frame members 246, 250, 254, 258, and a second portion 318 that overlies at least a portion of an adjacent frame member 246, 250, 254, 258. Considering the bottom frame member 250, for example, the walls 310 of the left and right-side corner members 298 overlap the bottom frame member 250 to an extent permitting up to a total of one-half of an inch of adjustment of the combined length of the left and right-side corner members 298 and the bottom frame member 250 without any visible gaps between the corner members 298 and the bottom frame member 250. Each of the left and right-side corner members 298, therefore, permit up to one-quarter of an inch of adjustment of the spacing between the respective corner members 298 and the bottom frame member 250. Likewise, considering the left and right-side frame members 254, 258, for example, the walls 310 of the upper and lower corner members 298 overlap the frame members 254, 258 to an extent permitting up to a total of one-half of an inch of adjustment of the combined height of the upper and lower corner members 298 and the left and right-side frame members 254, 258 without any visible gaps between the corner members 298 and the frame member 254, 258. Alternatively, the walls may be sized to shield differently sized gaps between the corner members 298 and the frame members 246, 250, 254, 258.

With reference to FIG. 8, each of the frame members 246, 250, 254, 258 includes an extension or lip 322 engaged with the sash 18 (FIG. 9) to facilitate consistent spacing between the panel 226 and the sash 18 near each edge 230, 234, 238, 242 of the panel 226. Moreover, each of the lips 322 is sized to optimize the depth of an air pocket 222 between the sash 18 and the window assembly 210. For example, in the illustrated construction of the window assembly 210, the lips 322 are sized to provide a linear dimension S between the frame members 246, 250, 254, 258 and the sash 18 of about one inch. Alternatively, the lips 322 may be sized to provide any of a number of different depth values depending upon the particular individual insulation valves of the panel 226 and the sash 18.

The corner members 298 do not include any extensions or lips engaged with the sash 18. In addition, the respective walls 310 of the corner members 298 are spaced from the window frame 14 to provide a gap G between the window frame 14 and each of the corner members 298 (FIG. 9). Accordingly, air may flow freely in and out of the air pocket 222.

To create the window assembly 210, one would first cut the panel 226 to appropriate length and width dimensions. Then, the corner members 298 may be positioned on the respective corners of the panel 226, and the distance between the opposed corner members 298 may be measured to obtain the length of the frame member 246, 250, 254, 258 extending between those two corner members 298. As discussed above, the walls permit some leeway in the cut length of the frame members 246, 250, 254, 258 (e.g., up to one-half an inch total for each frame member 246, 250, 254, 258). If provided in standard lengths, the top, bottom, and side frame members 246, 250, 254, 258 are then individually cut according to the measured lengths of the respective frame members 246, 250, 254, 258. After the frame members 246, 250, 254, 258 are cut to length and the corner members 298 have been removed from the panel 226, the side edges 238, 242 of the panel 226 are inserted into the channels 266 of the side frame members 254, 258, causing the fingers 270 to resiliently deflect thereby securing the side frame members 254, 258 to the panel 226.

Two corner members 298 may then be attached to the respective ends of each of the top frame member 246 and the bottom frame member 250. The pre-assembled corner members 298 and frame members 246, 250 may then be attached to the top and bottom edges 230, 234 of the panel 226, simultaneously inserting the vertically oriented posts 302 of the corner members 298 (i.e., from the frame of reference of FIG. 7) into the apertures 306 of the side frame members 254, 258.

Figure 10:
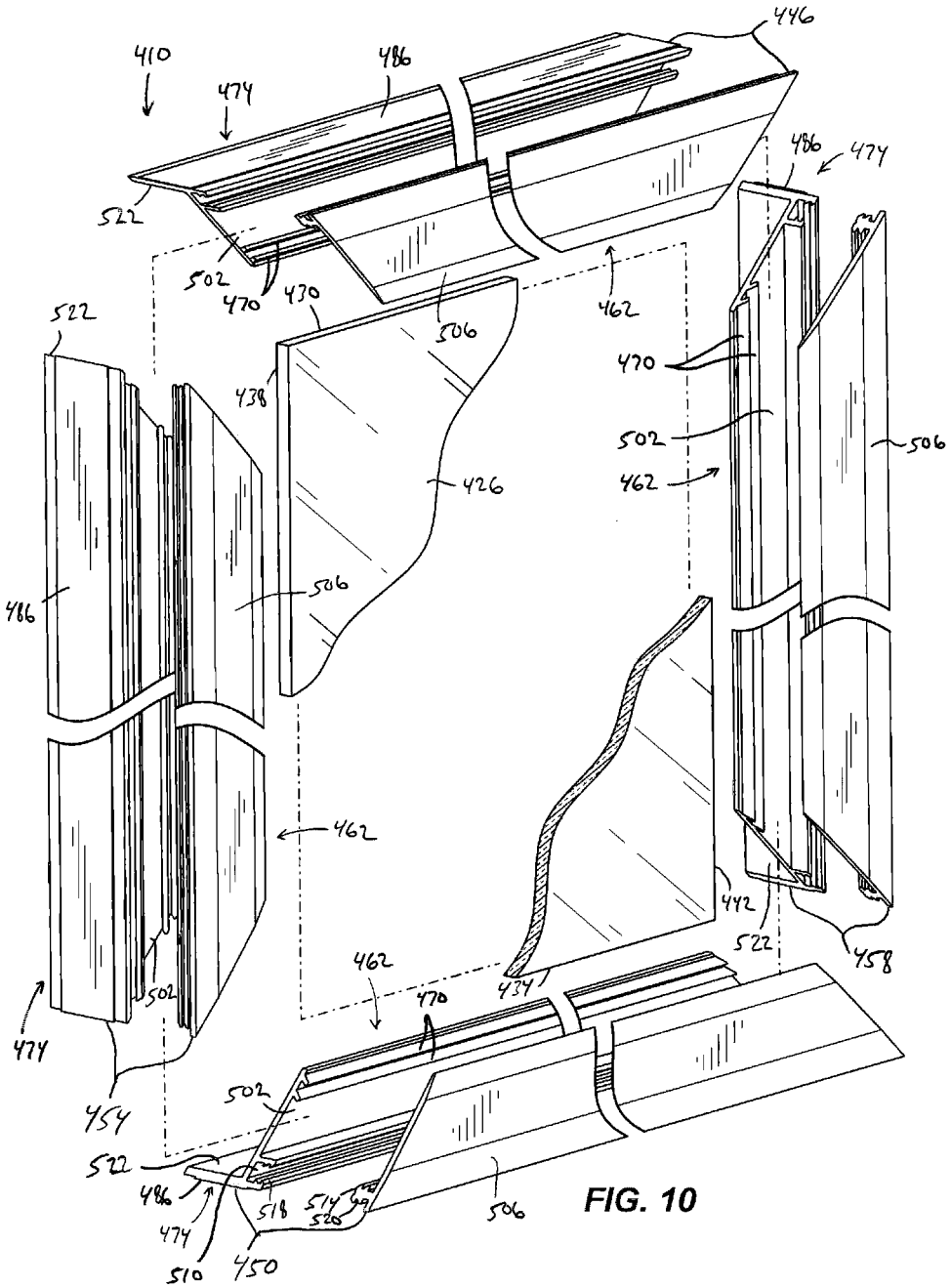
FIG. 10 is an exploded perspective view of a window assembly according to yet another embodiment of the invention.
Figure 11:
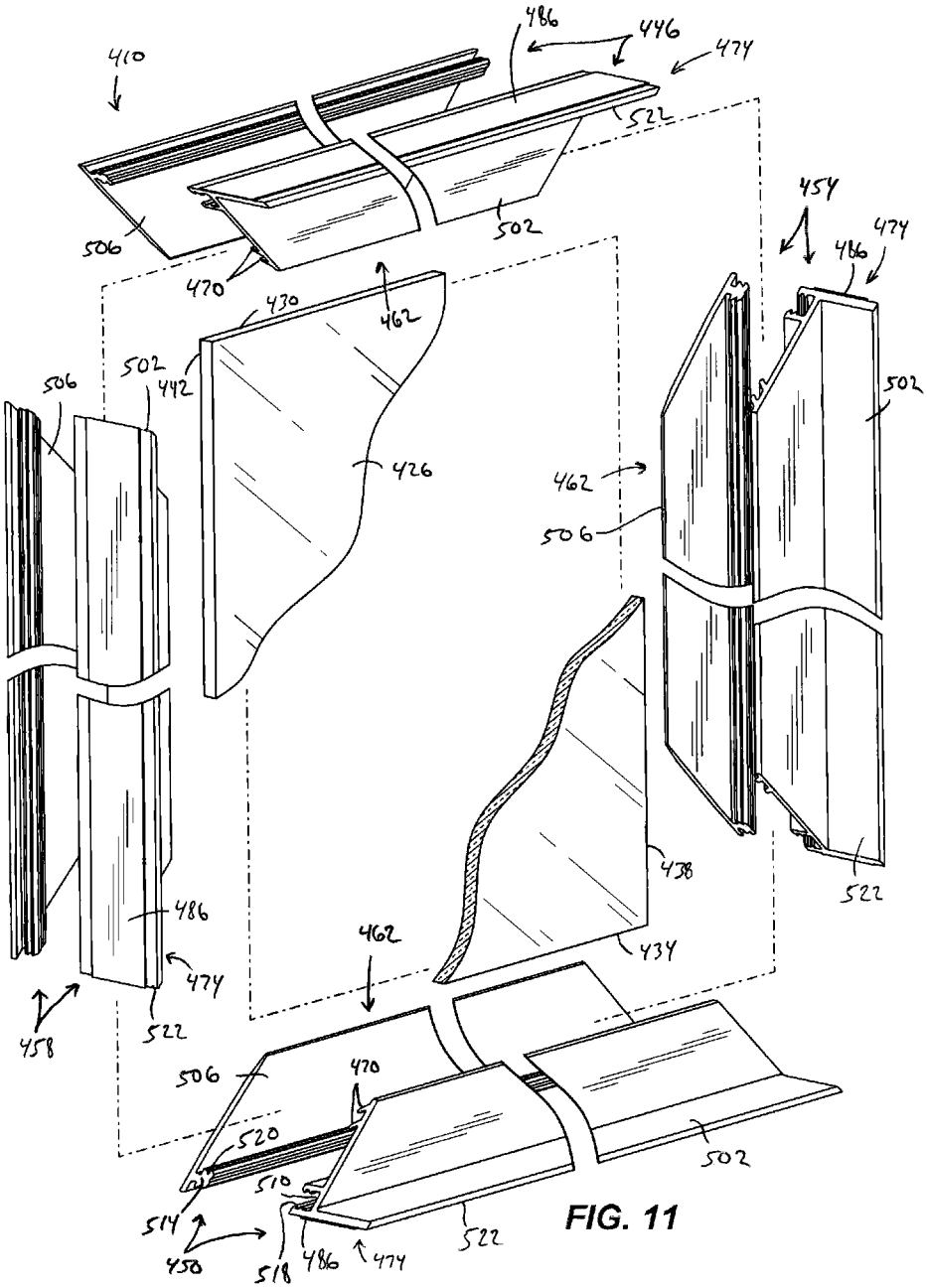
FIG. 11 is a reverse, exploded perspective view of the window assembly of FIG. 10.
Figure 12:
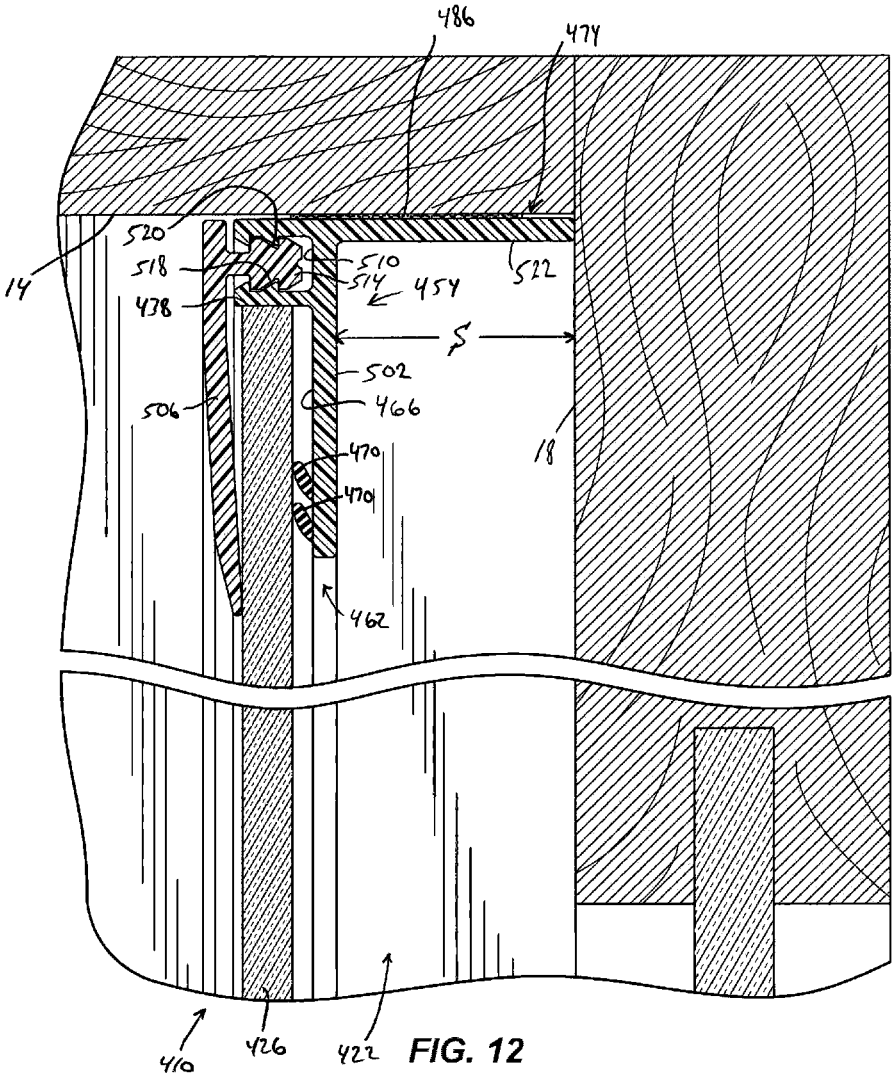
FIG. 12 is a cross-sectional view of the window assembly of FIG. 10 installed within a window frame and sash.

FIGS. 10-12 illustrate a window assembly 410 according to yet another embodiment of the invention that may be removably coupled to the window frame 14 shown in FIG. 1. With reference to FIGS. 10 and 11, the window assembly 410 includes a panel 426 having a top edge 430, a bottom edge 434, and two side edges 438, 442 interconnecting the top and bottom edges 430, 434. The panel 426 is transparent, and may be made from a plastic material or glass. Preferably, the panel 426 is made from a transparent thermoplastic, such as an acrylate polymer (for example, polymethyl methacrylate or polycarbonate).

The window assembly 410 also includes elongated top, bottom, and side frame members 446, 450, 454, 458 that are attached, respectively, to the top, bottom, and side edges 430, 434, 438, 442 of the panel 426. Each of the frame members 446, 450, 454, 458 includes a substantially identical cross-sectional shape in a plane that is oriented normal to the length of the respective frame members 446, 450, 454, 458. The frame members 446, 450, 454, 458 may also be made from a plastic material and manufactured using an extrusion process.

As such, the frame members 446, 450, 454, 458 can be manufactured in generic or standard lengths, and custom trimmed by the end user (e.g., using shears or a saw) in accordance with the particular dimensions of the window frame 14 in which the window assembly 410 will be installed.

With continued reference to FIGS. 10 and 11, each of the frame members 446, 450, 454, 458 includes a base 502 and a cover 506, the combination of which defines an inboard portion 462 to which the panel 426 is attached. In the illustrated construction of the window assembly 410, each of the bases includes a groove 510 having a cross-sectional shape that is complementary to the cross-sectional shape of a projection 514 on each of the covers 506 such that the projection 514 may be received within the groove 510 (FIG. 12). The groove 510 is defined by spaced tangs 518 having a complementary shape to respective recesses 520 in the projection 514 in which the tangs 518 are received. The inter-engagement of the tangs 518 and the projection 514 secures the cover 506 to the base 502, and is sufficient to substantially inhibit the cover 506 from being inadvertently removed from the base 502. Alternatively, the tangs 518 and the recesses 520 may have any of a number of different complementary cross-sectional shapes to secure the cover 506 to the base 502.

The inboard portion 462 of each of the frame members 446, 450, 454, 458 includes a channel 466 and two resiliently deflectable fingers 470 extending into the channel 466 from the base 502 (FIG. 12). The fingers 470 deflect upwardly from the frame of reference of FIG. 12 in response to insertion of the panel 426 within the channel 466. The fingers 470, therefore, effectively function as barbs to secure the frame members 446, 450, 454, 458 to the respective edges 430, 434, 438, 442 of the panel 426 and inhibit inadvertent removal of the frame members 446, 450, 454, 458 from the panel 426. In the illustrated construction of the window assembly 410, the fingers 470 are integrally formed as a single piece with the remainder of the respective frame members 446, 450, 454, 458 using a dual-durometer extrusion process. As such, the fingers 470 may be extruded using a flexible polymeric material (e.g., flexible PVC), while the remainder of the frame members 446, 450, 454, 458 may be extruded using a rigid polymeric material (e.g., rigid PVC). Alternatively, more or fewer fingers 470 may be used in each of the frame members 446, 450, 454, 458.

With reference to FIGS. 10 and 11, each of the frame members 446, 450, 454, 458 also includes an outboard portion 474 including an adhesive seal 486 to secure the base 502 of each of the frame members 446, 450, 454, 458 to the window frame 14. As such, the bases of each of the frame members 446, 450, 454, 458 are semi-permanently connected to the window frame 14, while the covers 506 of the respective frame members 446, 450, 454, 458 are removable to remove the panel 426 from the window assembly 410.

With reference to FIGS. 10-11, each of the frame members 446, 450, 454, 458 includes an extension or lip 522 engaged with the sash 18 (FIG. 12) to facilitate consistent spacing between the panel 426 and the sash 18 near each edge 430, 434, 438, 442 of the panel 426. Moreover, each of the lips 522 is sized to optimize the depth of an air pocket 422 between the sash 18 and the window assembly 410. For example, in the illustrated construction of the window assembly 410, the lips 522 are sized to provide a linear dimension S between the frame members 446, 450, 454, 458 and the sash 18 of about one inch. Alternatively, the lips 522 may be sized to provide any of a number of different depth values depending upon the particular individual insulation valves of the panel 426 and the sash 18.

To create the window assembly 410, one would first cut the panel 426 to appropriate length and width dimensions. Then, the top, bottom, and side frame members 446, 450, 454, 458 are individually cut to appropriate length dimensions in accordance with the dimensions of the panel 426. The respective ends of the frame members 446, 450, 454, 458 are miter cut as shown in FIGS. 10 and 11, and the edges 430, 434, 438, 442 of the panel 426 are inserted into the channels 466 of the frame members 446, 450, 454, 458, causing the fingers 470 to resiliently deflect thereby securing the frame members 446, 450, 454, 458 to the panel 426. The finished window assembly 410 may then be positioned within the window frame 14 to engage the adhesive seal 486 with the window frame 14 to secure the window assembly 410 in the window frame 14.

Figure 14:
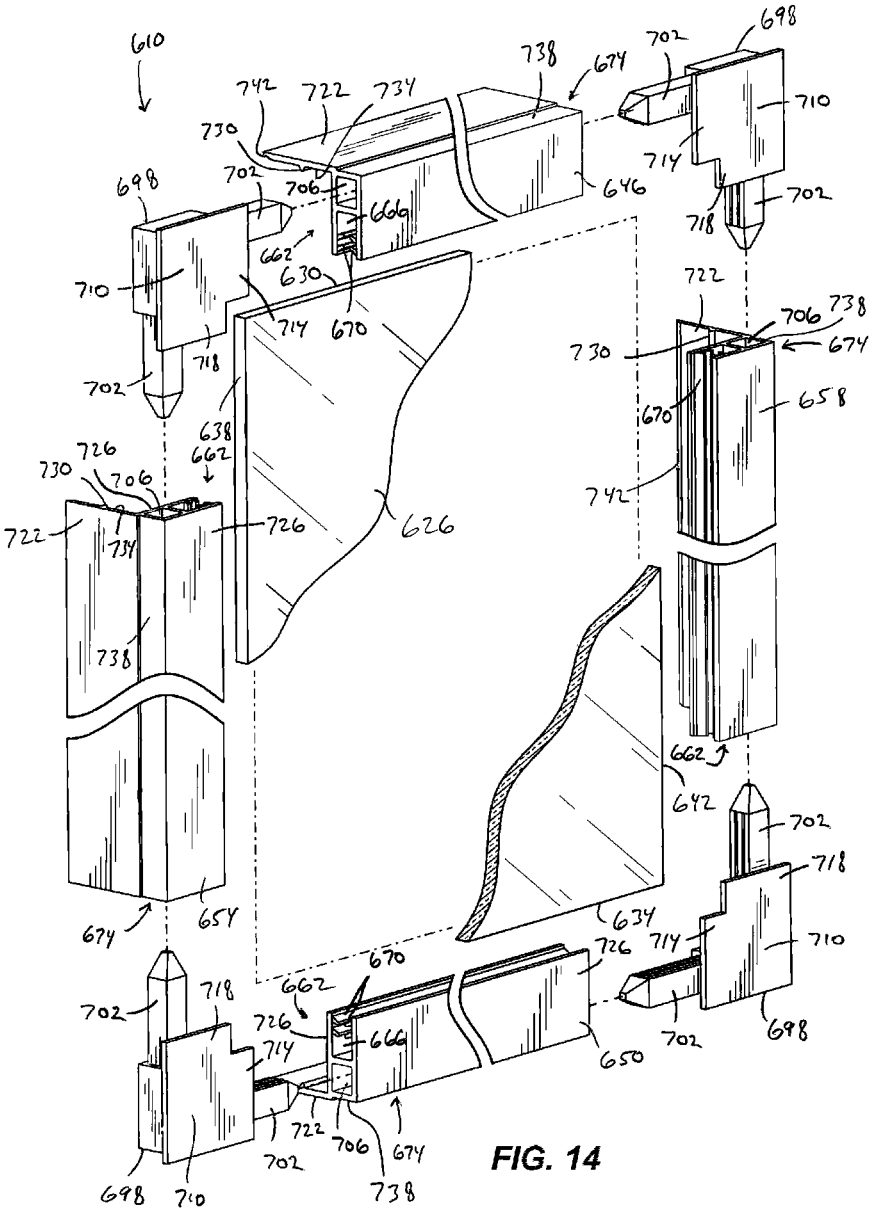
FIG. 14 is an exploded perspective view of a window assembly according to a further embodiment of the invention.
Figure 15:
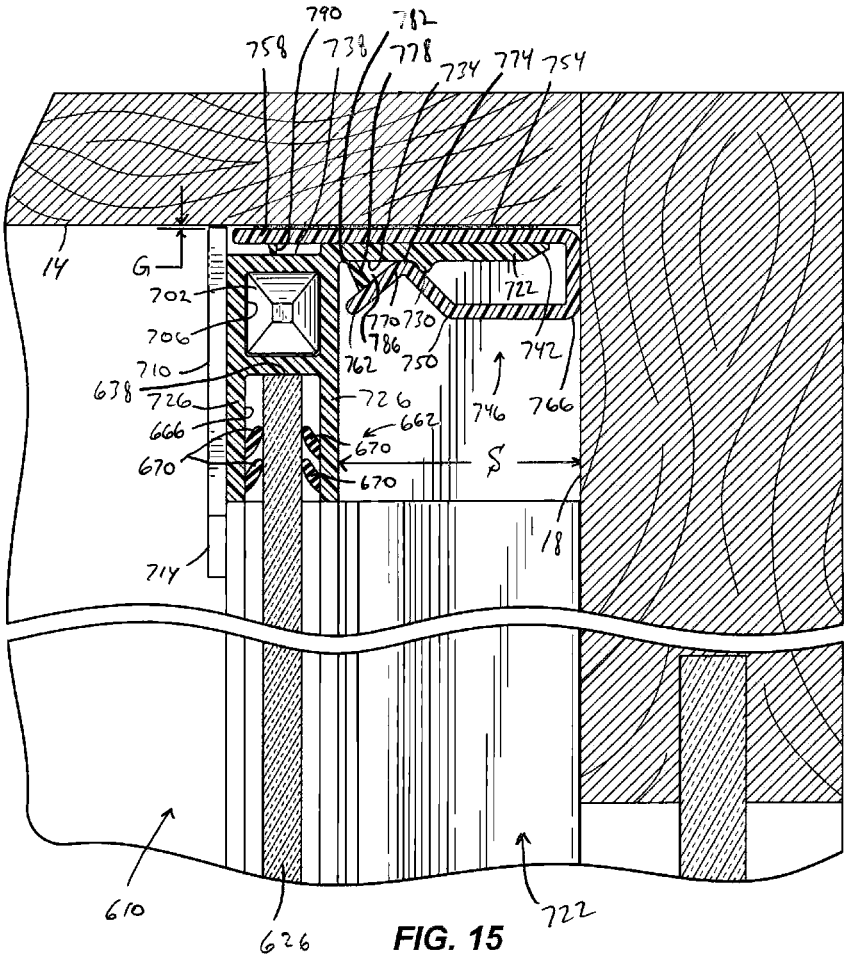
FIG. 15 is a cross-sectional view of the window assembly of FIG. 14 installed within a window frame and sash.

FIGS. 14 and 15 illustrate a window assembly 610 according to another embodiment of the invention that may be removably coupled to the window frame 14 shown in FIG. 1. With reference to FIG. 14, the window assembly 610 includes a panel 626 having a top edge 630, a bottom edge 634, and two side edges 638, 642 interconnecting the top and bottom edges 630, 634. The panel 626 is transparent, and may be made from a plastic material or glass. Preferably, the panel 626 is made from a transparent thermoplastic, such as an acrylate polymer (for example, polymethyl methacrylate or polycarbonate).

The window assembly 610 also includes elongated top, bottom, and side frame members 646, 650, 654, 658 that are attached, respectively, to the top, bottom, and side edges 630, 634, 638, 642 of the panel 626. Each of the frame members 646, 650, 654, 658 includes a substantially identical cross-sectional shape in a plane that is oriented normal to the length of the respective frame members 646, 650, 654, 658. The frame members 646, 650, 654, 658 may also be made from a plastic material and manufactured using an extrusion process. As such, the frame members 646, 650, 654, 658 can be manufactured in generic or standard lengths, and custom trimmed by the end user (e.g., using shears or a saw) in accordance with the particular dimensions of the window frame 14 in which the window assembly 610 will be installed.

With continued reference to FIG. 14, each of the frame members 646, 650, 654, 658 includes an inboard portion 662 to which the panel 626 is attached. In the illustrated construction of the window assembly 610, the inboard portion 662 of each of the frame members 646, 650, 654, 658 includes a channel 666 and four resiliently deflectable fingers 670 extending into the channel 666. Particularly, the fingers 670 are grouped in opposed pairs, and the panel 626 is engaged by the fingers 670 when inserted into the channel 666 (FIG. 15). The fingers 670 deflect upwardly from the frame of reference of FIG. 15 in response to insertion of the panel 626 between the fingers 670. The fingers 670, therefore, effectively function as barbs to secure the frame members 646, 650, 654, 658 to the respective edges 630, 634, 638, 642 of the panel 626 and inhibit inadvertent removal of the frame members 646, 650, 654, 658 from the panel 626. In the illustrated construction of the window assembly 610, the fingers 670 are integrally formed as a single piece with the remainder of the respective frame members 646, 650, 654, 658 using a dual-durometer extrusion process. As such, the fingers 670 may be extruded using a flexible polymeric material (e.g., flexible PVC), while the remainder of the frame members 646, 650, 654, 658 may be extruded using a rigid polymeric material (e.g., rigid PVC). Alternatively, more or fewer fingers 670 may be used in each of the frame members 646, 650, 654, 658. As a further alternative, the inboard portion 662 of each of the frame members 646, 650, 654, 658 may include different structure for securing the frame members 646, 650, 654, 658 to the respective edges 630, 634, 638, 642 of the panel 626 (e.g., fasteners, adhesives, etc.).

With reference to FIG. 14, the window assembly 610 includes four corner members 698 interconnecting adjacent frame members 646, 650, 654, 658. Each of the corner members 698 includes two protrusions or posts 702 that define an included angle of about ninety degrees. As a result, when adjacent frame members 646, 650, 654, 658 are interconnected by a corner member 698, the included angle between any two of the adjacent frame members 646, 650, 654, 658 is also about ninety degrees. Each of the frame members 646, 650, 654, 658 includes an aperture 706 extending longitudinally and positioned between the inboard portion 662 and the outboard portion 674 of the frame member 646, 650, 654, 658. In the illustrated construction of the window assembly 610, the posts 702 and the apertures 706 include complementary square cross-sectional shapes to permit the posts 702 to be received within the apertures 706. Alternatively, the posts 702 and the apertures 706 may include any number of different complementary cross-sectional shapes to interconnect adjacent frame members 646, 650, 654, 658. Also, in the illustrated construction of the window assembly 610, the posts 702 are interference fit to the respective apertures 706 to interconnect and secure the corner members 698 to adjacent frame members 646, 650, 654, 658. Alternatively, different structure may be utilized to secure the corner members 698 to the frame members 646, 650, 654, 658 after the posts 702 have been inserted into the apertures 706 (e.g., a set screw, adhesives, etc.).

With continued reference to FIG. 14, each of the corner members 698 includes a wall 710 having a first portion 714 that overlies at least a portion of one of the frame members 646, 650, 654, 658, and a second portion 718 that overlies at least a portion of an adjacent frame member 646, 650, 654, 658. Considering the bottom frame member 650, for example, the walls 710 of the left and right-side corner members 698 overlap the bottom frame member 650 to an extent permitting up to a total of one-half of an inch of adjustment of the combined length of the left and right-side corner members 698 and the bottom frame member 650 without any visible gaps between the corner members 698 and the bottom frame member 650. Each of the left and right-side corner members 698, therefore, permit up to one-quarter of an inch of adjustment of the spacing between the respective corner members 698 and the bottom frame member 650. Likewise, considering the left and right-side frame members 654, 658, for example, the walls 710 of the upper and lower corner members 698 overlap the frame members 654, 658 to an extent permitting up to a total of one-half of an inch of adjustment of the combined height of the upper and lower corner members 698 and the left and right-side frame members 654, 658 without any visible gaps between the corner members 698 and the frame member 654, 658. Alternatively, the walls may be sized to shield differently sized gaps between the corner members 698 and the frame members 646, 650, 654, 658.

With reference to FIGS. 14 and 15, each of the frame members 646, 650, 654, 658 includes an extension or lip 722 extending from the outboard portion 674 along the entire length of each of the frame members 646, 650, 654, 658. Particularly, each of the frame members 646, 650, 654, 658 includes parallel walls 726 between which the panel 626 is situated, and the lip 722 extends from one of the walls 726 at an included angle with the wall 726 of about 90 degrees (FIG. 15). Each of the lips 722 also includes a ridge 730 extending along the entire length of the lip 722. The ridge 730 is oriented parallel with the walls 726, such that a groove 734 having a substantially constant width is defined between one of the walls 726 and the ridge 730. Another groove 738 is defined on each of the frame members 646, 650, 654, 658 at a location forward of the groove 734 and on an opposite side of the lip 722 as the groove 734. Further, each of the lips 722 includes a tapered distal end 742, the purpose of which is described in detail below.

With reference to FIG. 15, the window assembly 610 is secured to the window frame 14 by a plurality of retainers 746, only one of which is shown. Particularly, the retainers 746 are configured as four retainer strips 750 corresponding to the respective frame members 646, 650, 654, 658 for interconnecting the frame members 646, 650, 654, 658 to respective sides of the window frame 14. The retainer strips 750 are secured to the sides of the window frame 14 using adhesive (e.g., double-sided adhesive tape 754), though the retainer strips 750 may be secured to the window frame 14 in any of a number of different manners (e.g., using fasteners, etc.). Each of the retainer strips 750 includes a first leg 758 attachable to the window frame 14 (i.e., using the adhesive tape 754) and a second leg 762 that is resiliently deflectable relative to the first leg 758. Particularly, each of the retainer strips 750 includes a living hinge 766 interconnecting the first and second legs 758, 762. Like the frame members 646, 650, 654, 658, the retainer strips 750 may be extruded in bulk lengths using a rigid polymeric material (e.g., rigid PVC).

With continued reference to FIG. 15, each of the retainer strips 750 also includes a projection 770 extending from the second leg 762 along the entire length of the retainer strip 750. The projection 770 includes an apex 774 biased into engagement with the first leg 758 (i.e., when the window assembly 610 is not yet assembled to the retainer strips 750) by the living hinge 766. Another projection 778 extending from the second leg 762 includes a distal end 782 that is also biased into engagement with the first leg 758 by the living hinge 766. Accordingly, an elongated channel 786 is defined between the respective projections 770, 778. Each of the retainer strips 750 also includes a yet another projection 790 extending from the first leg 758 along the entire length of the retainer strip 750. The projection 790 is oriented perpendicular to the first leg 758 and includes a shorter length than either of the projections 770, 778 on the second leg 762.

With continued reference to FIG. 15, the retainer strips 750 are engaged with the sash 18 to facilitate consistent spacing between the panel 626 and the sash 18 near each edge 630, 634, 638, 642 of the panel 626. Moreover, each of the retainer strips 750 is sized to optimize the depth of an air pocket 722 between the sash 18 and the window assembly 610. For example, in the illustrated construction of the window assembly 610, the retainer strips 750 are sized to provide a linear dimension S between the frame members 246, 250, 254, 258 and the sash 18 of at least 0.75 inches. Alternatively, the retainer strips 750 may be sized to provide any of a number of different depth values depending upon the particular individual insulation valves of the panel 626 and the sash 18.

The corner members 698 do not include any extensions or lips engaged with the retainer strips 750 or the sash 18. In addition, the respective walls 710 of the corner members 698 are spaced from the window frame 14 to provide a gap G between the window frame 14 and each of the corner members 698. Accordingly, air may flow freely in and out of the air pocket 722 through the gap G.

To create the window assembly 610, one would first cut the panel 626 to appropriate length and width dimensions. Then, the corner members 698 may be positioned on the respective corners of the panel 626, and the distance between the opposed corner members 698 may be measured to obtain the length of the frame member 646, 650, 654, 658 extending between those two corner members 698. As discussed above, the walls 710 permit some leeway in the cut length of the frame members 646, 650, 654, 658 (e.g., up to one-half an inch total for each frame member 646, 650, 654, 658). If provided in standard lengths, the top, bottom, and side frame members 646, 650, 654, 658 are then individually cut according to the measured lengths of the respective frame members 646, 650, 654, 658. After the frame members 646, 650, 654, 658 are cut to length and the corner members 698 have been removed from the panel 626, the side edges 638, 642 of the panel 626 are inserted into the channels 666 of the side frame members 654, 658, causing the fingers 670 to resiliently deflect thereby securing the side frame members 654, 658 to the panel 626.

Two corner members 698 may then be attached to the respective ends of each of the top frame member 646 and the bottom frame member 650. The pre-assembled corner members 698 and frame members 646, 650 may then be attached to the top and bottom edges 630, 634 of the panel 626, simultaneously inserting the vertically oriented posts 702 of the corner members 698 (i.e., from the frame of reference of FIG. 14) into the apertures 706 of the side frame members 654, 658.

The retainer strips 750 may be cut to length in accordance with the interior dimensions of the window frame 14 and attached to the window frame 14 using the adhesive tape 754. Of course, these steps may be taken prior or subsequent to construction of the window assembly 610. The window assembly 610 may then be secured to the retainer strips 750 by aligning the lips 722 of the respective frame members 646, 650, 654, 658 with the corresponding retainer strips 750 on the window frame 14. Particularly, the tapered distal end 742 of each of the lips 722 is initially engaged with the projection 778 on the corresponding retainer strips 750, and then the window assembly 610 is pushed toward the sill 18, thereby causing the second leg 762 of each of the retainer strips 750 to deflect away from the first leg 758 as the distal end 782 of the projection 778 slides over the tapered distal end 742 of the lip 722.

The distal end 782 of the projection 778 then encounters the ridge 730 on each of the lips 722 upon further pushing the window assembly 610 toward the sill 18. The window assembly 610 may be snap-fit to the retainer strips 750 in a first installed depth when the distal end 782 of the projection 778 slides over the ridge 730 (thereby causing the second leg 762 to resiliently deflect farther from the first leg 758) and is received in the groove 734, while simultaneously the projection 790 is received in the groove 738. In the first installed depth, the ridge 730 is also positioned in the elongated channel 786 defined between the two projections 770, 778 on the second leg 750. However, the window assembly 610 may also be snap-fit to the retainer strips 750 in a second installed depth (shown in FIG. 15), in which the window assembly 610 is pushed further toward the sill 18, causing the projection 770 to slide over the ridge 730 and snap into the groove 734 with the other projection 778. Accordingly, the window assembly 610 is secured to the window frame 14 in a rigid and semi-permanent manner. Alternatively, two or more of the frame members 646, 650, 654, 658 may include handles (not shown) to facilitate removal of the window assembly 610 from the retainer strips 750 and the window frame 14 for cleaning the panel 626 and/or the underlying window.

Various features of the invention are set forth in the following claims.

What is claimed is:

1. A window assembly adapted to be positioned within a window frame, the window assembly comprising:

a retainer positioned inside the window frame, the retainer including a first leg directly attachable to the window frame such that the window frame encloses the retainer and a second leg that is resiliently deflectable relative to the first leg, the second leg including one of a first projection and a first groove;

a transparent panel having an edge; and a frame member attached to the edge and including a lip extending along a substantial length of the frame member, the lip including the other of the first projection and the first groove, wherein the first projection is received in the first groove by a snap-fit to secure the lip between the first leg and the second leg of the retainer;

wherein the first leg of the retainer includes one of a second projection and a second groove, wherein the frame member includes the other of the second projection and the second groove, and wherein the second projection is received in the second groove.

2. The window assembly of claim 1, wherein the edge of the transparent panel is a first edge, the retainer is a first retainer attachable to a first side of the window frame, and the frame member is a first frame member, wherein the transparent panel includes a second edge adjacent the first edge, and wherein the window assembly further includes a second retainer attachable to a second side of the window frame adjacent the first side, and a second frame member attached to the second edge and including a lip secured to the second retainer by a snap-fit.

3. The window assembly of claim 2, further comprising a corner member interconnecting the first and second frame members.

4. The window assembly of claim 3, wherein the frame member includes an inboard portion to which the panel is attached and an outboard portion from which the lip extends.

5. The window assembly of claim 4, wherein the inboard portion of the frame member includes a channel and at least one resiliently deflectable finger extending into the channel, and wherein the panel is engaged by the finger to secure the frame member to the panel.

6. The window assembly of claim 5, wherein the inboard portion of the frame member includes at least two resiliently deflectable fingers extending into the channel, and wherein the panel is secured between the fingers of the frame member.

7. The window assembly of claim 4, wherein each of the first and second frame members includes a longitudinal aperture between the inboard portion and the outboard portion, and wherein the corner member includes a first protrusion at least partially received within the aperture of the first frame member, and a second protrusion at least partially received within the aperture of the second frame member.

8. The window assembly of claim 7, wherein the first protrusion is interference fit to the first aperture to interconnect the corner member to the first frame member, and wherein the second protrusion is interference fit to the second aperture to interconnect the corner member to the second frame member.

9. The window assembly of claim 7, wherein the first and second protrusions define an included angle of about ninety degrees.

10. The window assembly of claim 4, wherein the corner member includes a wall overlying at least a portion of each of the first and second frame members.

11. The window assembly of claim 1, wherein the retainer includes a living hinge interconnecting the first and second legs.

12. The window assembly of claim 1, wherein the retainer includes the first and second projections, and wherein the frame member includes the first and second grooves.

13. The window assembly of claim 12, wherein the first projection includes a distal end biased toward the first leg of the retainer.

14. The window assembly of claim 13, wherein the lip includes a ridge extending along a substantial length of the frame member, wherein the ridge at least partially defines the first groove, and wherein the distal end of the first projection is engageable with the ridge during the snap-fit.

15. The window assembly of claim 14, wherein the second leg resiliently deflects away from the first leg in response to the distal end of the first projection sliding over the ridge during insertion of the lip between the first and second legs.

16. The window assembly of claim 14, wherein the frame member includes spaced, parallel walls between which the edge of the panel is located, and wherein the first groove is defined between one of the walls and the ridge.

17. The window assembly of claim 1, further comprising an adhesive on the retainer for attaching the retainer to the window frame.

* * * * *